US009291954B1

(12) United States Patent
Kouzu

(10) Patent No.: US 9,291,954 B1
(45) Date of Patent: Mar. 22, 2016

(54) IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Norio Kouzu, Mishima Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/624,445

(22) Filed: Feb. 17, 2015

(51) Int. Cl.

| | |
|---|---|
| ***G03G 21/16*** | (2006.01) |
| ***G03G 15/16*** | (2006.01) |
| *H01R 39/00* | (2006.01) |

(52) U.S. Cl.
CPC ..... *G03G 15/1665* (2013.01); *G03G 15/161* (2013.01); *G03G 15/1605* (2013.01); *G03G 2215/0119* (2013.01); *G03G 2221/1642* (2013.01); *H01R 39/00* (2013.01)

(58) Field of Classification Search
USPC ..... 399/90, 121
See application file for complete search history.

(56) References Cited

U.S. PATENT DOCUMENTS

| | | | | | |
|---|---|---|---|---|---|
| 6,144,822 | A * | 11/2000 | Yamaguchi et al. | ..... | 399/121 |
| 6,298,212 | B1 * | 10/2001 | Kono et al. | ..... | 399/302 |
| 8,521,063 | B2 * | 8/2013 | Saito et al. | ..... | 399/121 |
| 2009/0129815 | A1 * | 5/2009 | Kouzu | ..... | 399/121 |
| 2010/0008696 | A1 * | 1/2010 | Furuya et al. | ..... | 399/101 |
| 2011/0064458 | A1 * | 3/2011 | Kawai | ..... | 399/110 |
| 2012/0051801 | A1 * | 3/2012 | Tabb et al. | ..... | 399/302 |
| 2012/0207507 | A1 * | 8/2012 | Okamoto et al. | ..... | 399/89 |

FOREIGN PATENT DOCUMENTS

| | | | | |
|---|---|---|---|---|
| JP | 2013-097372 | | 5/2013 | |
| JP | 2013-097373 | * | 5/2013 | ..... G03G 15/16 |

* cited by examiner

*Primary Examiner* — Clayton E LaBalle
*Assistant Examiner* — Kevin Butler
(74) *Attorney, Agent, or Firm* — Patterson & Sheridan, LLP

(57) ABSTRACT

In accordance with one embodiment, an image forming apparatus comprises an image forming section configured to form an image on an image carrier, a transfer roller configured to transfer the image formed on the image carrier to an image receiving medium, a support body configured to support the image carrier in a main body opposite to the transfer roller, a holding member arranged in the support body to hold two end parts of the transfer roller and having a conductive member that makes electrical contact with the transfer roller when the transfer roller is mounted in the holding member, and a power supply section configured to apply transfer bias to the image carrier and to the transfer roller through the conductive member.

17 Claims, 7 Drawing Sheets

IMAGE FORMING APPARATUS

FIELD

Embodiments described herein relate generally to an image forming apparatus such as a copier, a printer and an MFP (Multi-Function Peripheral).

BACKGROUND

Conventionally, in an image forming apparatus such as an MFP and the like, a toner image on a photoconductive drum is transferred to a transfer belt. The toner image transferred to the transfer belt is then transferred to an image receiving medium (paper) by a transfer roller. The transfer belt is rotated through the rotation of a driving roller. The driving roller is arranged opposite to the transfer roller.

When the sheet passes through the space between the driving roller and the transfer roller, transfer voltage is applied to the sheet so that the toner image on the transfer belt can be transferred to the paper.

A conduction path is arranged in the transfer roller to apply the transfer voltage (also referred to as bias). The conduction path may include a leaf spring in contact with a metal shaft of the transfer roller. Alternatively, there is an example in which a leaf spring is in contact with a conduction section assembled to the metal shaft. The leaf spring is electrically connected to a high-voltage path or to ground.

When arranging the transfer roller on a sheet conveyance path, it is necessary to make the jam processing (sheet jam releasing) easier. Thus, a transfer unit including the transfer roller is arranged in such a manner that the transfer unit can be opened and separated from the main body of the image forming apparatus. Consequently, the conduction path of the transfer roller is arranged at the side of the opened part. The conduction path at the side of the opened part is electrically connected to the main body, and so it is necessary to arrange the conduction path near the fulcrum of the opened part.

However, conduction paths of other electrical components are also arranged near the fulcrum, and so lots of conduction paths crowd the fulcrum region. As a result, the space needed to guarantee the creepage distance is increased for the paths needed to apply the transfer bias. Further, when the leaf spring is grounded, it is necessary to arrange a ground line, which leads to an increase in the number of the electrical components.

DETAILED DESCRIPTION

Figure 1:
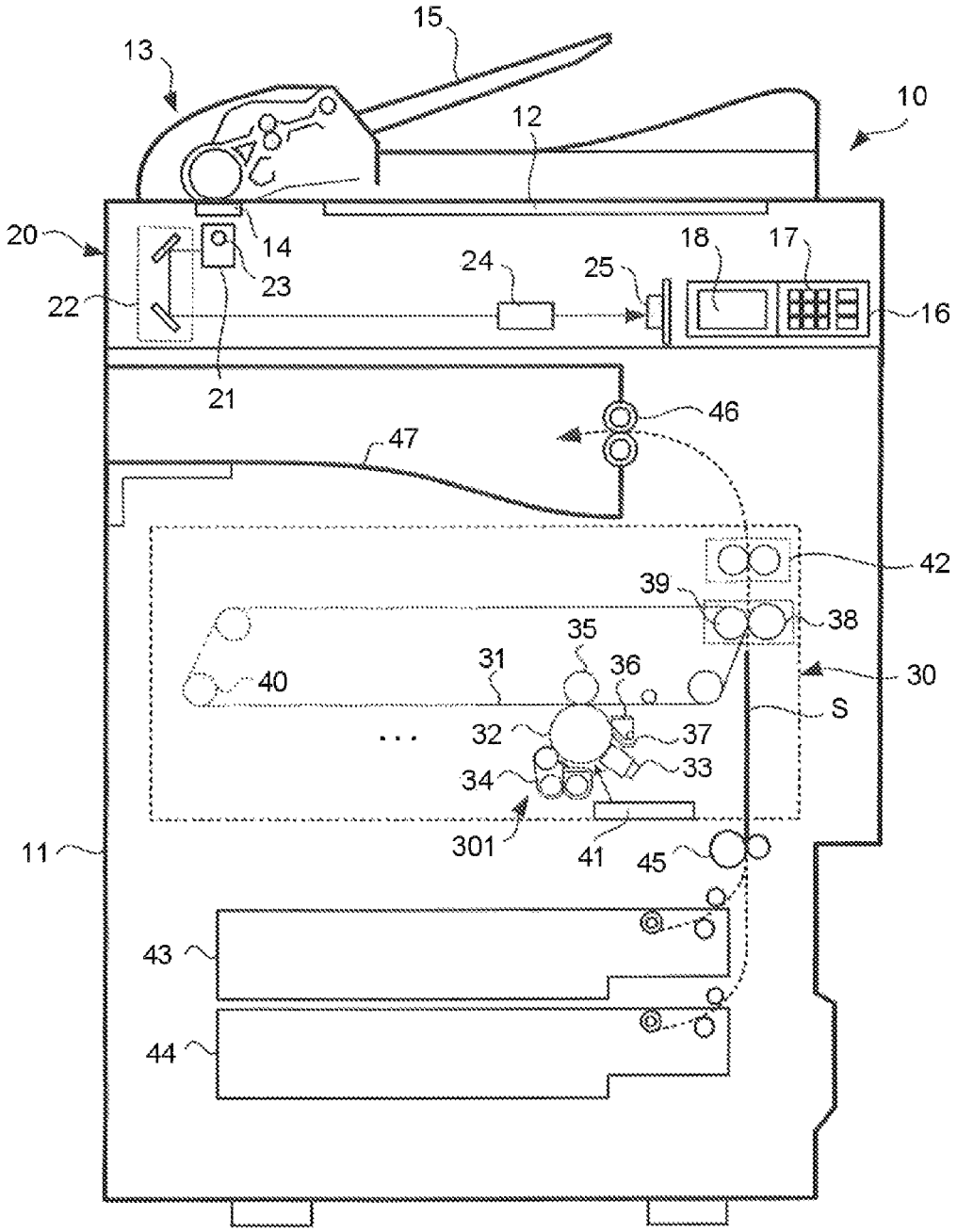
FIG. 1 is a diagram illustrating an image forming apparatus according to one embodiment.

In accordance with one embodiment, an image forming apparatus comprises an image forming section configured to form an image on an image carrier, a transfer roller configured to transfer the image formed on the image carrier to an image receiving medium, a support body configured to support the image carrier in a main body opposite to the transfer roller, a holding member arranged in the support body to hold two end parts of the transfer roller and having a conductive member that makes electrical contact with the transfer roller when the transfer roller is mounted in the holding member, and a power supply section configured to apply transfer bias to the image carrier and to the transfer roller through the conductive member.

Hereinafter, the image forming apparatus according to the embodiment is described in detail with reference to the accompanying drawings. The same components in each figure are applied with the same reference numerals.

A First Embodiment

FIG. 1 is a diagram illustrating an image forming apparatus according to the embodiment. In FIG. 1, an image forming apparatus 10 is, for example, a copier or an MFP (Multi-Function Peripherals) such as a multifunction peripheral and the like. In the following description, the example of the image forming apparatus 10 is an MFP.

A document table 12 is arranged on a main body 11 of the MFP 10. An automatic document feeder (ADF) 13 is arranged on the document table 12 in an openable manner. A glass 14, which is a document reading window, is fixed below the ADF 13. A tray 15 for placing the document is arranged in the ADF 13. Further, an operation panel 16 is arranged at the upper portion of the main body 11. The operation panel 16 includes various operation keys 17 and a touch panel type display section 18.

A scanner section 20 serving as an image reading device is arranged below the document table 12 of the MFP 10. The scanner section 20 scans the surface of the document conveyed by the ADF 13 or the surface of the document placed on the document table 12 to read the document. The scanner section 20 includes a first carriage 21 and a second carriage 22.

The first carriage 21, provided with a light source 23 for irradiating the document surface at the inside thereof, irradiates the document with the light from the light source 23. The light source 23 is, for example, an LED. The light source 23 extends in a horizontal scanning direction (depth direction of the sheet surface). The light reflected by the document is reflected by mirrors arranged in the first carriage 21 and the second carriage 22 and is guided to a CCD (Charge Coupled Device) line sensor 25 through a lens 24.

The CCD line sensor 25 is an image sensor. The light reflected from the document is photoelectrically converted by the CCD line sensor 25 and an electric signal is output from the CCD line sensor 25. The electric signal output from the CCD line sensor 25 is processed and converted into a digital signal. The digital signal is subjected to image processing to generate image data.

When reading the document fed by the ADF 13, the scanner section 20 fixes the first carriage 21 at a position relative to the glass 14 (below the ADF 13). The second carriage 22 is also located at a position nearby the first carriage 21. When reading the document placed on the document table 12, the scanner section 20 moves the first carriage 21 and the second carriage 22 in a vertical scanning direction parallel to the document table 12 to read the document placed on the document table 12.

The horizontal scanning direction is orthogonal to the moving direction of the first carriage 21. The horizontal scanning direction is equivalent to the arrangement direction of the CCD line sensor 25. The vertical scanning direction is orthogonal to the horizontal scanning direction.

A printer section 30 is arranged inside the main body 11 of the MFP 10. The printer section 30 includes a photoconductive drum, laser and the like. The printer section 30 processes the image data read by the scanner section 20 or the image data created by a PC (Personal Computer) and the like to form an image on the image receiving medium. In the following description, sheet S is described as the image receiving medium.

The printer section 30 includes an endless transfer belt 31 serving as an image carrier. Below the transfer belt 31 is arranged an image forming section 301 which scans and exposes the surface of a photoconductive drum 32 with laser beams from a laser 41. An electrostatic latent image is formed on the photoconductive drum 32 through the exposure processing. The laser 41 emits laser light based on the image data read by the scanner section 20. An electrostatic charger 33, a developing device 34, a primary transfer roller 35, a cleaner 36, a blade 37 and the like are arranged around the photoconductive drum 32.

The electrostatic charger 33 fully charges the surface of the photoconductive drum 32 uniformly. The developing device 34 includes a mixer and a developing roller. The mixer stirs developing agent. Developing bias is applied to the developing roller to supply the toner serving as two-component developing agent including toner and carrier for the photoconductive drum 32.

The toner image on the photoconductive drum 32 is transferred to the transfer belt 31 by the primary transfer roller 35. The cleaner 36 removes the toner left on the surface of the photoconductive drum 32 with the blade 37. The toner image transferred to the transfer belt 31 is transferred to the sheet S by the secondary transfer roller 38.

The transfer belt 31 is tensioned by a driving roller 39 and a driven roller 40 and moved through the rotation of the driving roller 39. The driving roller 39 is arranged opposite to the secondary transfer roller 38. The sheet S is conveyed to pass through the space between the driving roller 39 and the secondary transfer roller 38. When the sheet S passes through the space between the driving roller 39 and the secondary transfer roller 38, secondary transfer voltage is applied to the sheet S through the secondary transfer roller 38. In this way, the toner image on the transfer belt 31 is secondarily transferred to the sheet S.

The toner image transferred to the sheet S is fixed on the sheet S by a fixing device 42. The fixing device 42 includes a fixing roller and a pressing roller. The sheet S is passed through the space between the fixing roller and the pressing roller to heat and press the sheet S, in this way, the toner image is fixed on the sheet S.

When forming a color image, the printer section 30 includes a plurality of image forming sections 301, that is, yellow (Y), magenta (M), cyan (C) and black (K) image forming sections 301. The plurality of image forming sections 301 are arranged below the transfer belt 31 in a direction from the upstream side to the downstream side. The plurality of image forming sections 301 is structurally identical to each other; therefore, only one image forming section 301 is shown in FIG. 1. In addition, the configuration of the printer section 30 is not limited to the example described above, and the printer section 30 may be of any type.

A plurality of cassettes 43 and 44 is arranged at the lower portion of the main body 11 to store sheets of various sizes. The number of the cassettes is not limited to two. A conveyance roller 45 is arranged on a conveyance path from the cassettes 43 and 44 to the secondary transfer roller 38. The conveyance roller 45 conveys the sheet S picked up from each of the cassettes 43 and 44 to the printer section 30. The sheet S on which the toner image is fixed by the fixing device 42 is discharged to a sheet discharge section 47 by a discharge roller 46. For convenience, the secondary transfer roller 38 is simply referred to as transfer roller 38 in the following description.

Figure 2:
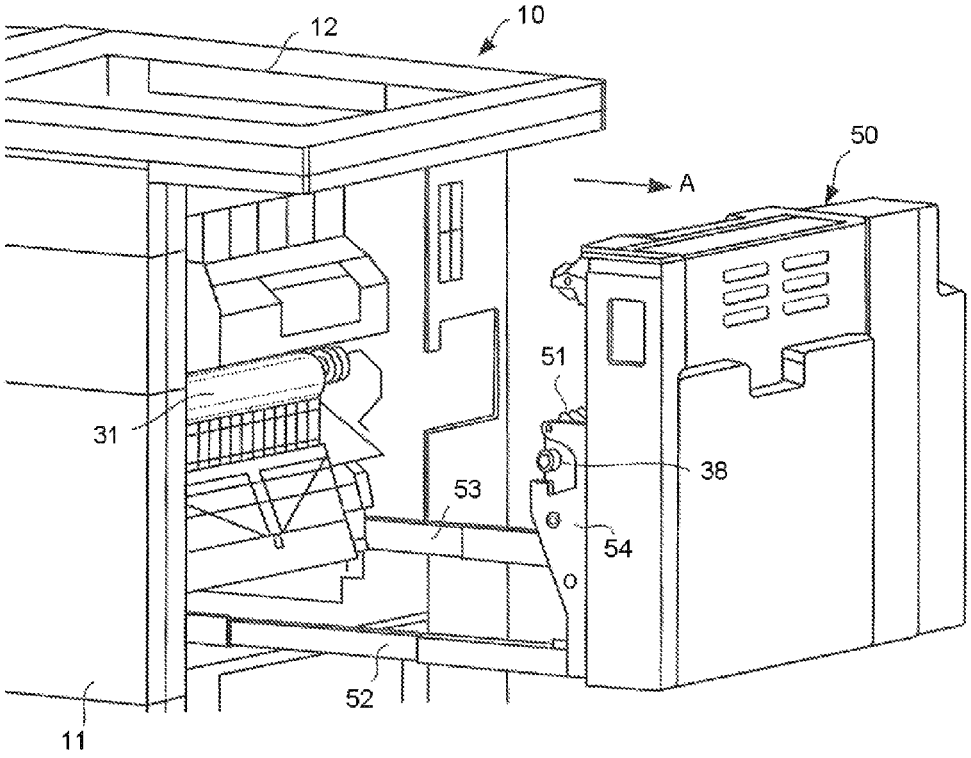
FIG. 2 is a perspective view schematically illustrating the configuration of an open section which supports a transfer unit and a main body of the image forming apparatus.

FIG. 2 is a perspective view schematically illustrating the configuration of an open section 50 which supports a transfer unit 51, and the main body 11 of the image forming apparatus. When arranging the transfer roller 38 on the sheet conveyance path, the open section 50 is configured to be detachable from the main body 11. Jam processing and the like can be carried out easily by detaching the open section 50 from the main body 11. FIG. 2 shows a state in which the open section 50 is drawn out in an outward direction (direction indicated by an arrow A).

The open section 50 can be drawn out along rails 52 and 53. When the open section 50 is drawn out, the transfer belt 31 arranged inside the main body 11 is exposed. A supporting section 54 is arranged in the open section 50 to support the transfer unit 51. The transfer roller 38 is arranged in the transfer unit 51. When the open section 50 is drawn out, the transfer belt 31 and the transfer roller 38 are separated from each other.

If a jam occurs, an operator draws out the open section 50 to separate the transfer roller 38 from the transfer belt 31. When the transfer belt 31 and the transfer roller 38 are separated from each other, the sheet conveyance path is exposed. Thus, the sheet causing the jam can be removed easily.

Figure 3:
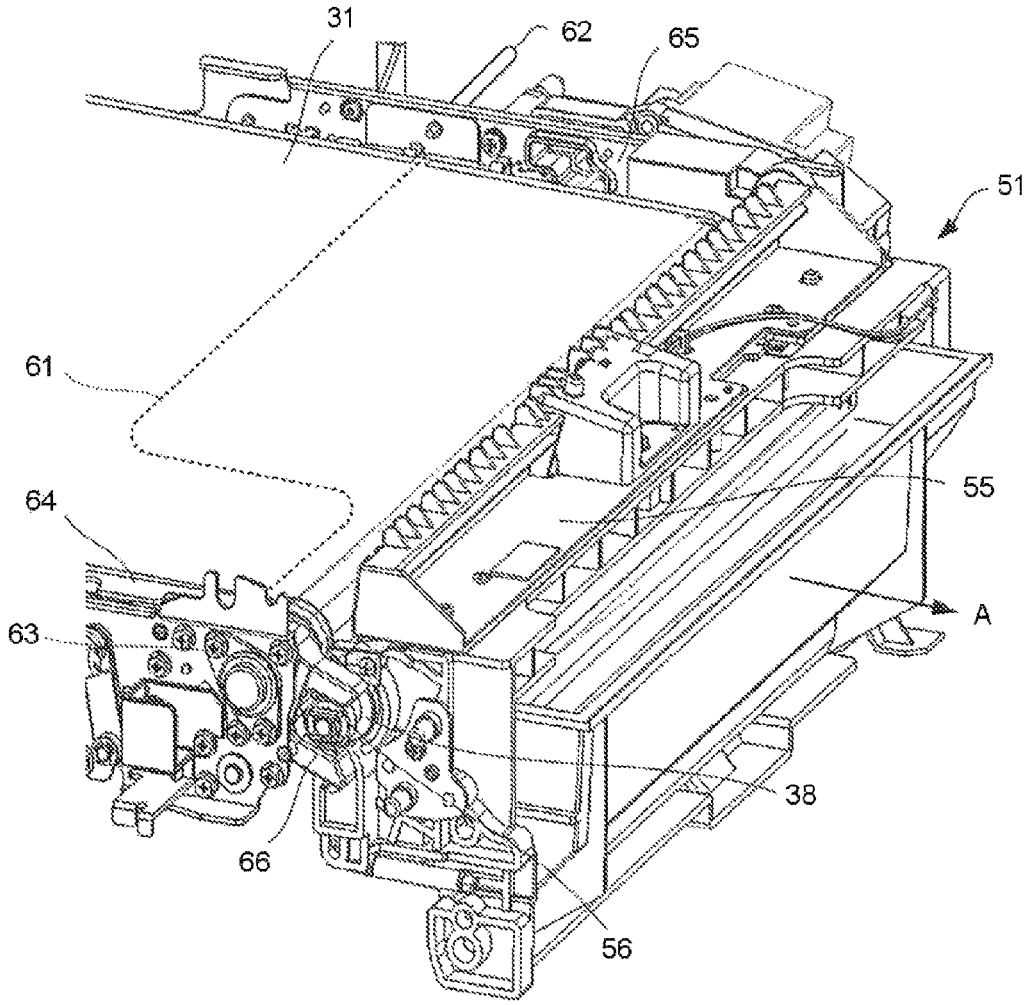
FIG. 3 is a perspective view illustrating the configuration of a transfer belt and the transfer unit of the embodiment.
Figure 4:
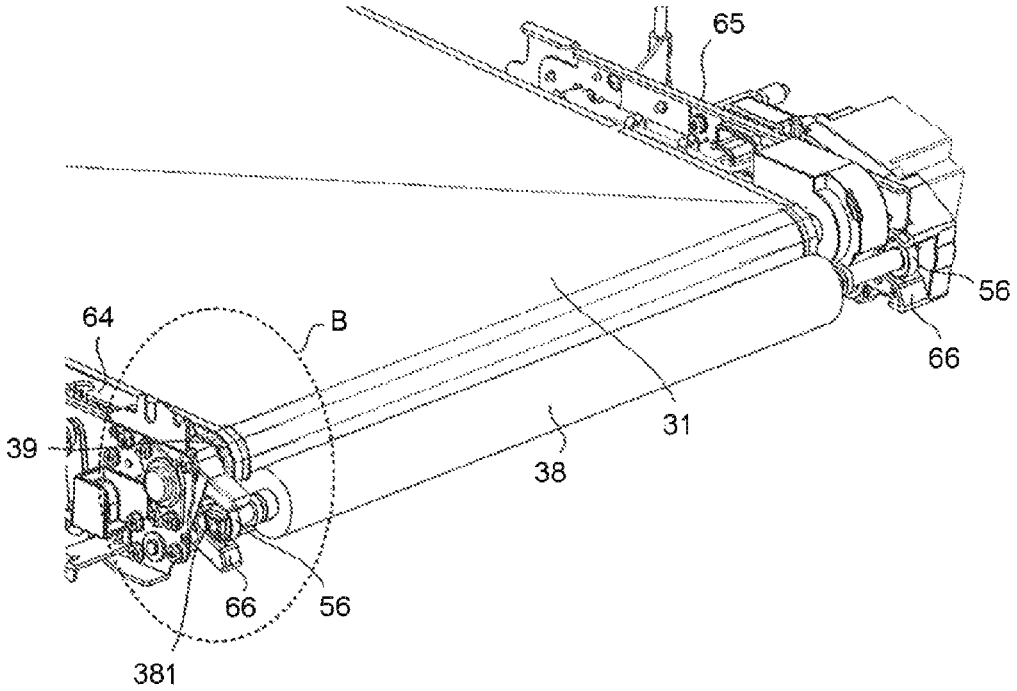
FIG. 4 is a perspective view illustrating a state in which the transfer belt and a transfer roller are in contact with each other.

FIG. 3 is a perspective view illustrating the configuration of the transfer belt 31 and the transfer unit 51. The transfer unit 51 is generally in a connected state in which the transfer belt 31 and the transfer roller 38 are in contact with each other. FIG. 4 is a perspective view illustrating a state in which the transfer belt 31 and the transfer roller 38 are in contact with each other.

In FIG. 3, the transfer roller 38 is shielded by a cover 55 of the transfer unit 51 while only a bearing 56 arranged at two ends of the transfer roller 38 can be seen. The bearing 56 supports the rotation shaft 381 of the transfer roller 38.

A high-voltage substrate with which one end of a cable 61 is connected is arranged inside the transfer belt 31. The other end of the cable 61 is connected with a power supply terminal 62. Thus, voltage is supplied to the high-voltage substrate from the power supply terminal 62 through the cable 61. Further, transfer bias is applied to a bearing 63 of the driving roller 39 from a voltage source arranged in the high-voltage substrate.

Two ends of the driving roller 39 are supported by support bodies 64 and 65 arranged in the main body 11. A holding member 66 is arranged at the end parts of the support bodies 64 and 65 at the sides of the transfer roller 38. The holding member 66 positions and fixes the bearing 56 of the transfer roller 38. The holding member 66, which is a U-shaped arm, holds the bearing 56 with the front end part of the arm. In the following description, the holding member 66 is referred to as holding arm 66.

As the method of applying transfer bias, voltage is applied to the bearing of the driving roller 39 and the rotation shaft 381 of the transfer roller 38 is grounded. Alternatively, voltage is applied to the rotation shaft 381 of the transfer roller 38 and the bearing of the driving roller 39 is grounded.

Figure 5:
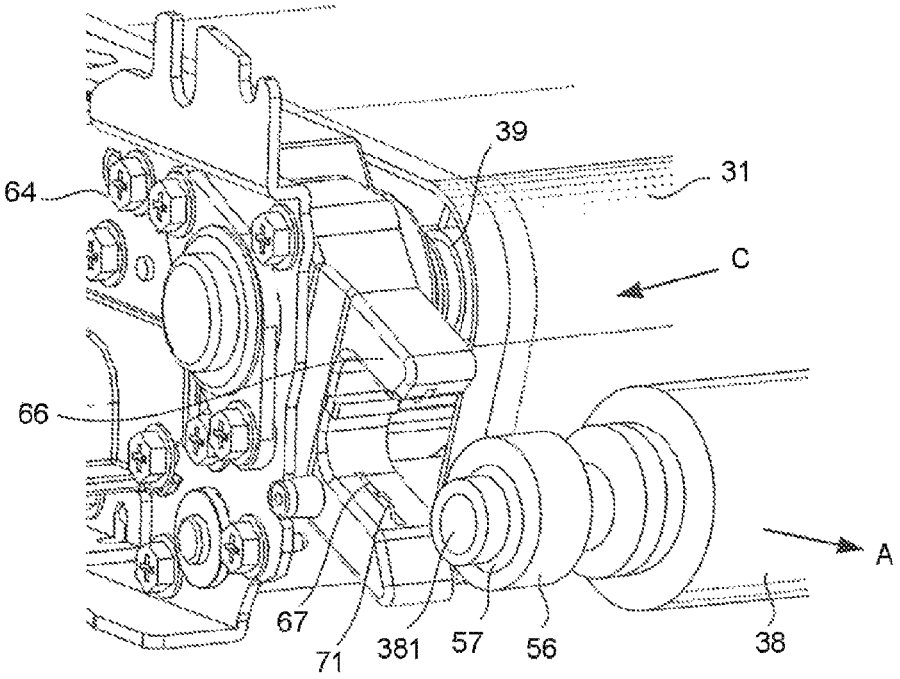
FIG. 5 is an enlarged perspective view of the part enclosed by circle B in FIG. 4.

FIG. 5 is an enlarged perspective view of the part enclosed by circle B in FIG. 4. A state in which the transfer roller 38 is taken out from the holding arm 66 is shown. The transfer roller 38 is generally in such a state that the bearing 56 thereof is supported by the holding arm 66. When carrying out jam processing and the like, the open section 50 is drawn out in the direction indicated by the arrow A to draw the transfer roller 38 out from the holding arm 66.

A conductive member 70 (shown in FIG. 6 in detail) is arranged in the holding arm 66. Similar to the holding arm 66, the conductive member 70 is a linear U-shaped spring. Two ends of the conductive member 70 are curved (referred to as a curvature part 71) to protrude in a direction (the direction of the bearing 56) towards the inside of the holding arm 66. When the bearing 56 of the transfer roller 38 is mounted in the holding arm 66, the curvature part 71 formed at two ends of the conductive member 70 makes contact with the bearing 56. The conductive member 70 is grounded with a ground point (GND) arranged at the side of the main body 11.

Figure 6:
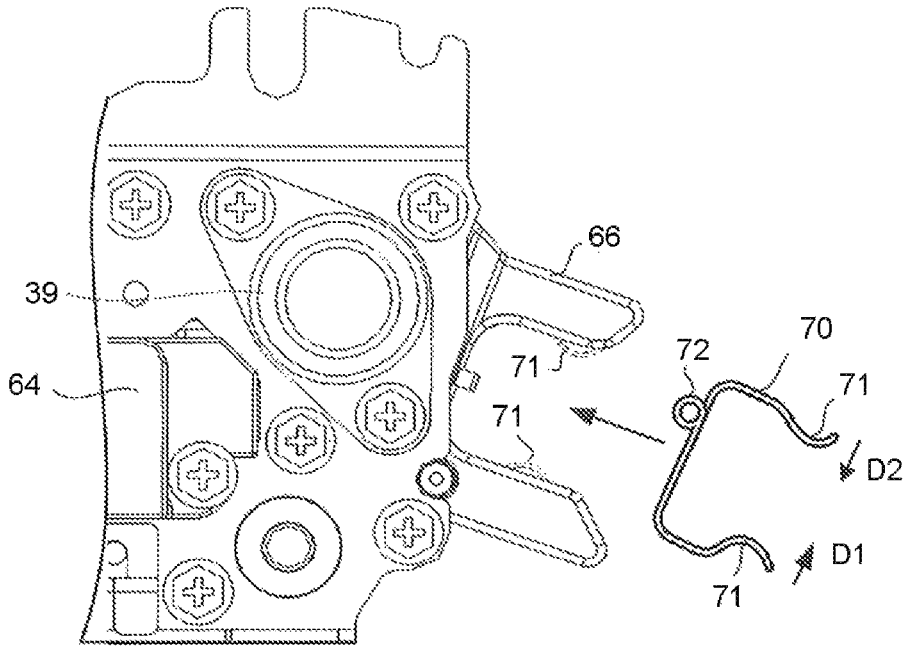
FIG. 6 is an enlarged front view of a holding arm of the embodiment.
Figure 7:
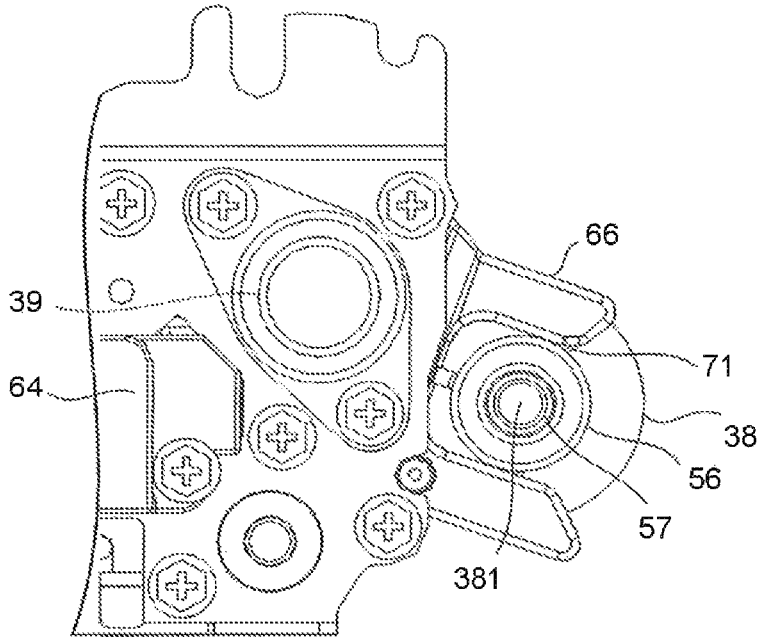
FIG. 7 is an enlarged front view illustrating a state in which the transfer roller is mounted in the holding arm of the embodiment.

FIG. 6 is an enlarged front view of the holding arm 66. FIG. 7 is an enlarged front view illustrating a state in which the transfer roller 38 is mounted in the holding arm 66.

As shown in FIG. 6, the conductive member 70 is a linear U-shaped member having elasticity. The curvature part 71 is formed at the front ends of the conductive member 70. A circle shaped twisted part 72 is formed at the center part of the conductive member 70. The conductive member 70 has a spring force in a direction (directions indicated by arrows D1 and D2) towards the inside of the holding arm 66 through the twisted part 72. As shown in FIG. 5, a groove 67 from which the curvature part 71 of the conductive member 70 protrudes is formed in the holding arm 66. Thus, when the conductive member 70 is mounted in the holding arm 66, the curvature part 71 protrudes from the groove 67.

As shown in FIG. 7, when the bearing 56 of the transfer roller 38 is fitted into the holding arm 66, the curvature part 71 is pressed into the groove 67 by the bearing 56. Thus, the conductive member 70 is tightly connected with the bearing 56.

Figure 8:
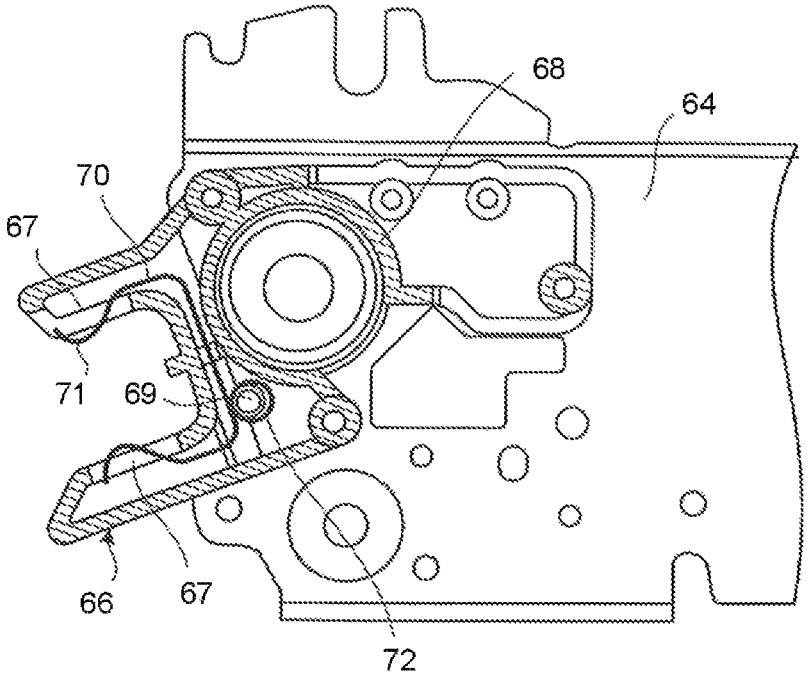
FIG. 8 is a cross-sectional view illustrating the configuration of the holding arm and a spring of the embodiment.
Figure 9:
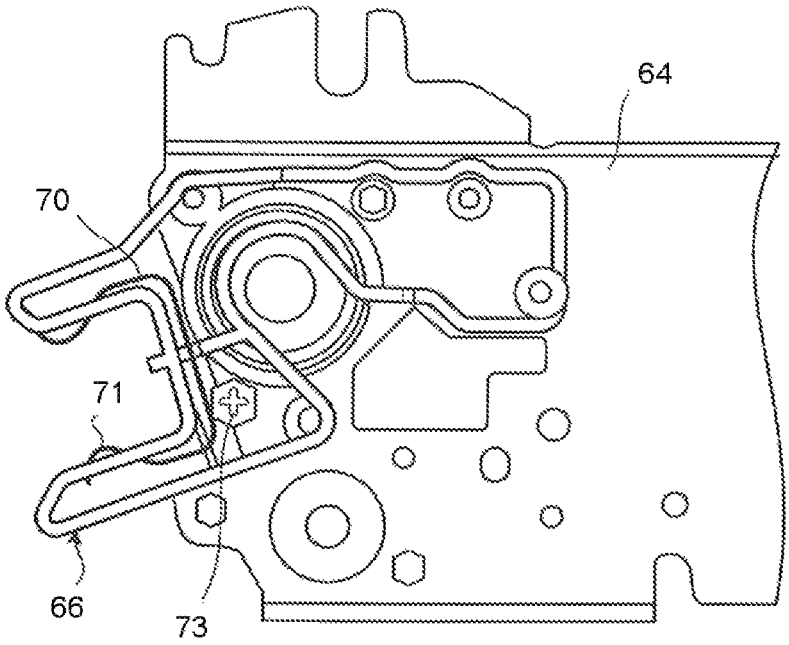
FIG. 9 is a side view illustrating the configuration of the holding arm in a state in which the spring is mounted.

FIG. 8 is a cross-sectional view taken in a direction indicated by an arrow C in FIG. 5 illustrating the configuration of the holding arm 66. FIG. 9 is a side view illustrating the configuration of the holding arm 66 in a state in which the conductive member 70 is mounted.

As shown in FIG. 8, the holding arm 66 is formed by arranging a cylindrical main body 68 on the support body 64 (or the support body 65). Two grooves 67 are formed to face each other at two end parts of the holding arm 66. A columnar fixing section 69 is arranged in the support body 64. The twisted part 72 of the conductive member 70 is mounted in the fixing section 69. When the conductive member 70 is mounted in the holding arm 66, as shown in FIG. 8, the curvature part 71 protrudes from the groove 67. As shown in FIG. 9, when a screw 73 is screwed into the fixing section 69, the twisted part 72 of the conductive member 70 is fixed in the support body 64. Further, the conductive member 70 is grounded with the support body 64 through the screw 73.

The holding arm 66 for positioning is made of nonconductive material such as plastic and the like. When supplying power to the transfer roller 38, the conductive member 70 is electrically connected with the high-voltage substrate in the transfer belt 31. When grounding the transfer roller 38, the transfer roller 38 is electrically connected with the conduction path (ground) in the transfer belt 31 through the conductive member 70.

Figure 10:
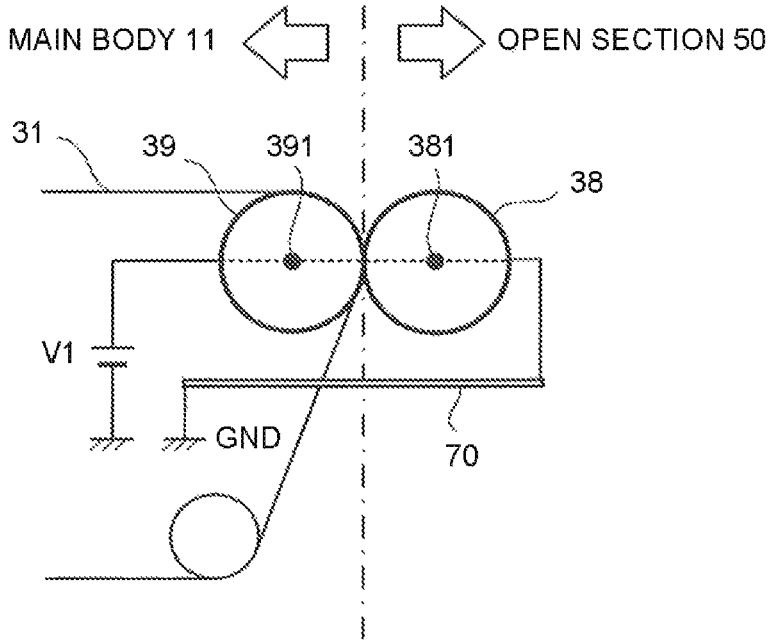
FIG. 10 is a schematic diagram illustrating a power supply section configured to supply power from a driving roller to the transfer roller.

FIG. 10 is a schematic diagram illustrating one example of a power supply section. FIG. 10 shows a case where transfer bias is supplied from the driving roller 39 to the transfer roller 38. In FIG. 10, transfer bias is applied to the rotation shaft 391 of the driving roller 39 from a voltage source V1 arranged in the main body 11. The transfer roller 38 is connected with the ground point (GND) of the main body 11 through the conductive member 70.

Figure 11:
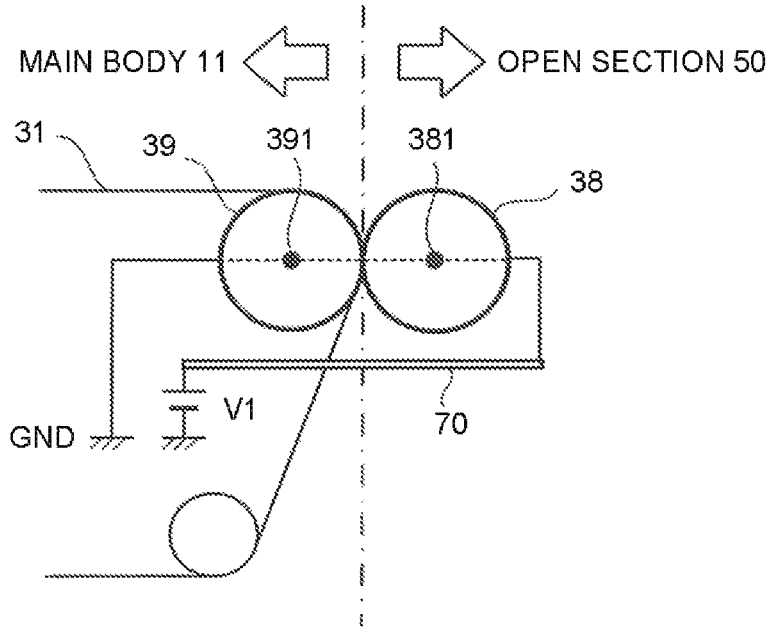
FIG. 11 is a schematic diagram illustrating a power supply section configured to supply power from the transfer roller to the driving roller.

FIG. 11 is a schematic diagram illustrating another example of the power supply section. FIG. 11 shows a case where transfer bias is supplied from the transfer roller 38 to the driving roller 39. In FIG. 11, transfer bias is applied to the rotation shaft 381 of the transfer roller 38 from a voltage source V1 arranged in the main body 11 through the conductive member 70. The rotation shaft 391 of the driving roller 39 is connected with the ground point (GND) of the main body 11.

In either of the configurations shown in FIG. 10 and FIG. 11, the conductive member 70 is arranged on the conduction path between the voltage source V1 and the ground point. Further, both the voltage source V1 and the ground point (GND) are arranged at the side of the main body 11. Thus, in a case in which the transfer unit 51 is separated from the main body 11 due to the occurrence of jam and the like, the bearing 56 of the transfer roller 38 is detached from the conductive member 70.

As stated above, in the present embodiment, the conductive member 70 includes a linear spring arranged in the holding arm 66 used for positioning the transfer roller 38. The transfer roller 38 is grounded through the conductive member 70. Alternatively, power may be supplied to the transfer roller 38 through the conductive member 70. That is, the conductive member 70 may function as ground or an electrical contact for power supply.

Thus, the conduction path of the transfer roller 38 arranged at the side of the open section 50 can be achieved through the conductive member 70 electrically connected to the main body 11. In this way, the complex wiring for electrical connection is not needed. Further, the conductive member 70 that includes a conductive spring can be in tight contact with the transfer roller 38.

When the open section 50 is opened for jam processing or maintenance processing, the transfer roller 38 is separated from the holding arm 66, and so the electrical connection between the transfer roller 38 and the conductive member 70 is cut off. Thus, the trouble caused by the electrical wiring is avoided.

Moreover, the bearing 56 at the end parts of the transfer roller 38 is connected with the rotation shaft 381 through a conductive bearing 57, and is in contact with the conductive member 70 at the two ends of the transfer roller 38. Further, the conductive member 70 is in contact with the bearing 56 of the transfer roller 38 at the center position of the holding arm 66, thus, a stable electrical connection can be achieved.

Though the holding arm 66 for positioning the transfer roller 38 is arranged at two end parts of the transfer roller 38, the conductive member 70 may be arranged at one end or both ends of the transfer roller 38.

In accordance with the image forming apparatus according to the embodiment described above, the conduction path of the transfer unit 51 can be aggregated at the side of the main body 11. Thus, there is no need to arrange a cable and the like for applying transfer bias to the transfer unit 51, which can simplify the electrical connections. Further, the conductive components are not deformed when replacing the transfer roller 38 to thereby reduce faults.

Furthermore, the present invention is not limited to the embodiment described above, and various applications can be implemented. For example, although it is described herein that the transfer unit 51 is drawn out along the rails 52 and 53 and opened and separated from the main body 11, it is not limited to this. The upper portion of the transfer unit 51 may be rotated around a fulcrum arranged at the lower portion of the transfer unit 51 to open the transfer unit 51. In addition, the shape of the conductive member 70 is not limited to the shape shown in the figures.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

an image forming section configured to form an image on an image carrier;

a transfer roller configured to transfer the image formed on the image carrier to an image receiving medium;

a support body configured to support the image carrier in a main body opposite to the transfer roller;

a holding member positioned in the support body and configured to hold two end parts of the transfer roller and having a U-shaped conductive spring positioned so that a part of the conductive spring makes electrical contact with the transfer roller when the two end parts of the transfer roller are held in the holding member; and a power supply section configured to apply transfer bias between the image carrier and the transfer roller through the conductive member.

2. The image forming apparatus according to claim 1, wherein the power supply section includes a power supply terminal and a ground point in the main body, and the conductive spring is arranged on a conduction path between the power supply terminal and the ground point.

3. The image forming apparatus according to claim 1, wherein the transfer roller includes a rotation shaft with two end parts, at least one of the end parts having a bearing, and the bearing is in electrical contact with the conductive spring when the transfer roller is held in the holding member.

4. The image forming apparatus according to claim 3, wherein the holding member comprises a U-shaped holding arm for holding the bearing.

5. The image forming apparatus according to claim 4, wherein the holding arm includes grooves at positions facing the bearing of the transfer roller, and end parts of the conductive spring protrude from the grooves towards the bearing.

6. The image forming apparatus according to claim 1, wherein the image carrier is a transfer belt rotated by a driving roller, and the transfer belt is positioned opposite to the transfer roller.

7. The image forming apparatus according to claim 6, wherein a transfer unit including the transfer roller is positioned in a section that can be opened from the main body, and the transfer roller is separated from the transfer belt when the section is opened.

8. The image forming apparatus according to claim 1, wherein the power supply section includes a voltage source for applying bias voltage between a rotation shaft of a driving roller for the image carrier and a ground point with which a rotation shaft of the transfer roller is grounded through the conductive spring, the voltage source and the ground point being arranged inside the main body.

9. The image forming apparatus according to claim 1, wherein the power supply section includes a voltage source for applying bias voltage between a rotation shaft of the transfer roller through the conductive spring and a ground point with which a rotation shaft of a driving roller for the image carrier is grounded, the voltage source and the ground point being arranged inside the main body.

10. In an image forming apparatus having a main body including an image carrier and a section including a transfer roller that can be opened from the main body, the main body further including a support body that supports the image carrier and a holding member arranged in the support body and configured to hold the transfer roller opposite the image carrier when the section is closed, a method of applying transfer bias to the image carrier and to the transfer roller, said method comprising:

applying bias voltage from a voltage source to a rotation shaft of a driving roller for the image carrier; and electrically connecting a rotation shaft of the transfer roller to a ground point through a U-shaped conductive spring positioned in the holding member, the conductive spring making electrical contact with the transfer roller when the transfer roller is mounted in the holding member.

11. The method according to claim 10, wherein the transfer roller includes two end parts of the rotation shaft, at least one of the end parts having a bearing, and the bearing is in electrical contact with the conductive spring when the transfer roller is held in the holding member.

12. The method according to claim 11, wherein the holding member comprises a U-shaped holding arm for holding the bearing.

13. The method according to claim 12, wherein the holding arm includes grooves at positions facing the bearing of the transfer roller, and end parts of the conductive spring protrude from the grooves towards the bearing.

14. In an image forming apparatus having a main body including an image carrier and a section including a transfer roller that can be opened from the main body, the main body further including a support body that supports the image carrier and a holding member arranged in the support body and configured to hold the transfer roller opposite the image carrier when the section is closed, a method of applying transfer bias to the image carrier and to the transfer roller, said method comprising:

applying bias voltage from a voltage source to a rotation shaft of the transfer roller through a U-shaped conductive spring positioned in the holding member, the conductive spring making electrical contact with the transfer roller when the transfer roller is mounted in the holding member; and electrically connecting a rotation shaft of a driving roller for the image carrier to a ground point, wherein the conductive spring positioned so that a part of the conductive spring is in electrical contact with the transfer roller when the transfer roller is held in the holding member.

15. The method according to claim 14, wherein the transfer roller includes two end parts of the rotation shaft, at least one of the end parts having a bearing, and the bearing is in electrical contact with the conductive spring when the transfer roller is held in the holding member.

16. The method according to claim 15, wherein the holding member comprises a U-shaped holding arm for holding the bearing.

17. The method according to claim 16, wherein the holding arm includes grooves at positions facing the bearing of the transfer roller, and end parts of the conductive spring protrude from the grooves towards the bearing.

* * * * *